US010526838B2

(12) United States Patent
Chang et al.

(10) Patent No.: US 10,526,838 B2
(45) Date of Patent: Jan. 7, 2020

(54) DRAINAGE ASSEMBLY FOR AN AUTOMATIC DOOR

(71) Applicant: OSI Industries, LLC, Aurora, IL (US)

(72) Inventors: Tao Chang, Geneva, IL (US); Mike Yeager, Yorkville, IL (US); Sone Phimsouay, West Valley City, UT (US); Dan Werner, Aurora, IL (US)

(73) Assignee: OSI Industries, LLC, Aurora, IL (US)

( * ) Notice: Subject to any disclaimer, the term of this patent is extended or adjusted under 35 U.S.C. 154(b) by 176 days.

(21) Appl. No.: 15/668,544

(22) Filed: Aug. 3, 2017

(65) Prior Publication Data

US 2018/0119482 A1 May 3, 2018

Related U.S. Application Data

(60) Provisional application No. 62/371,367, filed on Aug. 5, 2016, provisional application No. 62/465,487, filed on Mar. 1, 2017.

(51) Int. Cl.

| | |
|---|---|
| ***E06B 9/17*** | (2006.01) |
| ***E06B 7/14*** | (2006.01) |
| ***E06B 9/68*** | (2006.01) |

(52) U.S. Cl.

CPC ..... *E06B 7/14* (2013.01); *E06B 9/17* (2013.01); *E06B 9/68* (2013.01); *E06B 2009/6818* (2013.01)

(58) Field of Classification Search

CPC ..... E06B 7/14; E06B 9/17; E06B 9/68; E06B 2009/6818; E06B 2009/17084;

(Continued)

(56) References Cited

U.S. PATENT DOCUMENTS 2,141,515 A * 12/1938 Casse ..... E05D 15/38 16/194
4,422,264 A * 12/1983 Harris ..... E06B 11/00 49/121

(Continued)

FOREIGN PATENT DOCUMENTS

WO 2010101836 A2 9/2010

OTHER PUBLICATIONS

Korean Intellectual Property Office, International Search Report for PCT/US2017/045578, dated Nov. 27, 2017 (3 pages).

(Continued)

*Primary Examiner* — Katherine W Mitchell
*Assistant Examiner* — Abe Massad
(74) *Attorney, Agent, or Firm* — Joseph A. Fuchs; Greensfelder, Hemker & Gale, P.C.

(57) ABSTRACT

The present invention provides a liquid drainage assembly for an automatic, roll-up door and has an attaching member connecting a drip tray to a surface proximate the door. The attaching member moves drip tray from a position where the tray is disposed under a bottom edge of the door to collect liquid flowing across the bottom edge when the door is in an open position to a position where the tray is outside the vertical plane in which the door moves to allow the door to move to a closed position. A motor moves the door in response to signals received from a controller which ensures coordinated movement of the door and the drip tray.

19 Claims, 8 Drawing Sheets

(58) Field of Classification Search
CPC ..... E06B 9/17076; E04H 4/084; E04H 4/086; E05D 15/22; E05D 2015/225; E04F 15/59
See application file for complete search history.

(56) References Cited

U.S. PATENT DOCUMENTS

| | | | | |
|---|---|---|---|---|
| 4,765,093 | A * | 8/1988 | Edwards, Jr. | E05D 15/38 49/197 |
| 4,953,608 | A | 9/1990 | Larsson | |
| 5,549,149 | A * | 8/1996 | Sills | A47K 3/006 160/201 |
| 7,204,291 | B2 * | 4/2007 | Last | E04H 4/082 160/133 |
| 7,810,280 | B2 * | 10/2010 | Hattori | E05F 15/63 49/340 |
| 8,627,605 | B2 * | 1/2014 | Drifka | E06B 9/17046 160/40 |
| 9,121,218 | B1 * | 9/2015 | Ladha | E06B 7/14 |
| 2001/0015265 | A1 | 8/2001 | Drifka et al. | |
| 2006/0226103 | A1 | 10/2006 | Streib et al. | |
| 2011/0283620 | A1 | 11/2011 | Drikfa | |

OTHER PUBLICATIONS

Korean Intellectual Property Office, Written Opinion of the International Searching Authority for PCTUS2017/045578, dated Nov. 27, 2017 (13 pages).

* cited by examiner

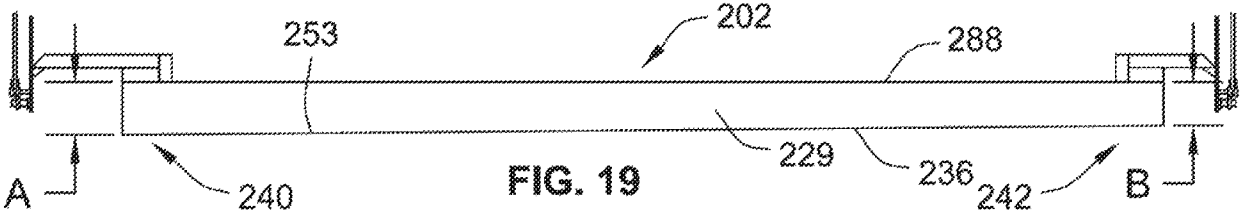
FIG. 19
FIG. 20
FIG. 21
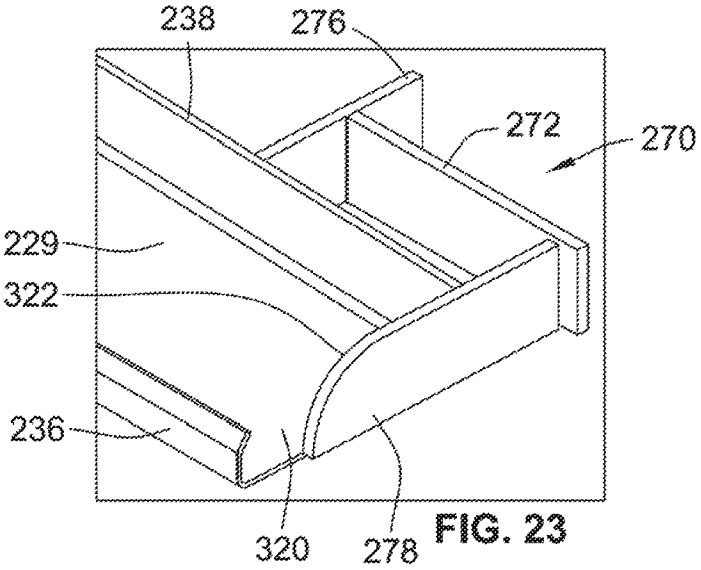
FIG. 23
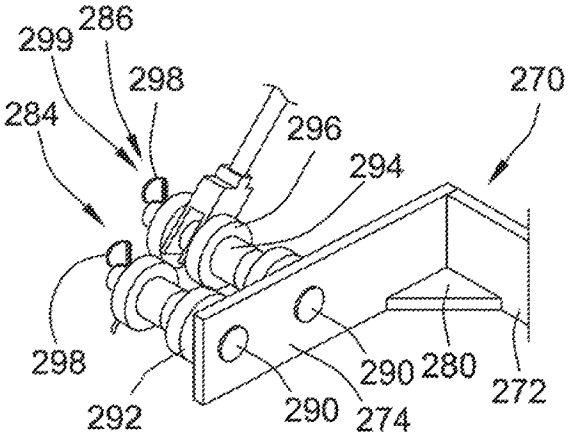
FIG. 22

DRAINAGE ASSEMBLY FOR AN AUTOMATIC DOOR

CROSS-REFERENCE TO RELATED APPLICATIONS

This application claims the benefit of the filing of U.S. Provisional Patent Application Ser. No. 62/371,367 filed Aug. 5, 2016 and U.S. Provisional Patent Application Ser. No. 62/465,487 filed on Mar. 1, 2017 both of which are incorporated in their entirety herein by reference and made a part hereof.

FEDERALLY SPONSORED RESEARCH OR DEVELOPMENT

N/A

FIELD OF THE INVENTION

The present invention provides a drainage assembly associated with an automatic opening door and more particularly a drainage assembly that deploys in response to the opening and closing of a vertically opening door that is moveable from a coiled/open position to an uncoiled/closed position.

DESCRIPTION OF THE PRIOR ART

Automatic roll up doors are in common use today on entrances to coolers or freezers or other enclosed chambers to allow access by vehicles such as fork lifts and people on foot. Moisture has a tendency to collect on a face of the door and upon opening and closing of the door the moisture flows downwardly onto the floor in the area of the opening to the chamber. The moisture pools over time and can cause a hazardous situation. Thus, the present invention provides a deployable drainage assembly associated with an automatically-opening door to catch the moisture flowing across a bottom edge of the door when the door is in an open position and to move to a position outside the path of the door so the door can close. The drainage assembly is automatically deployable in coordination with movement of the door.

SUMMARY OF THE INVENTION

The present invention provides a liquid drainage assembly for an automatic, roll-up door and has an attaching member connecting a drip tray to a surface proximate the door. The attaching member moves the drip tray from a position under a bottom edge of the door when the door is in an open position, to collect liquid flowing across the bottom edge, to a position where the tray is outside the vertical plane in which the door moves to allow movement to a closed position. A motor moves the door in response to signals received from a controller which ensures coordinated movement of the door and the drip tray.

The present invention also provides a liquid drainage assembly for a roll-up door mounted for movement along a vertical path from a closed position to an open position including a drip tray. The drip tray has a first end, a second end opposed to the first end, a front wall, a rear wall and a bottom wall connecting the front wall to the back wall. At the first end of the drip tray the front wall is spaced from the second wall by a first distance and at the second end of the drip tray the front wall is spaced from the back wall by a second distance less than the first distance. A first bracket is mounted proximate either the first end or the second end of the drip tray to define a connected end of the drip tray and supports a first segmented slot. A first member connects the connected end of the drip tray to the first segmented slot. A motive force is connected to the member to move the first bracket in the first segmented slot from a first position to a second position. When in the first position the drip tray is in the vertical path, and when in the second position it is outside the vertical path. A controller is connected to the motive force to move the first bracket to the first position when the door is in an open position and to move the first bracket to the second position prior to the door moving from the open position.

BRIEF DESCRIPTION OF THE DRAWINGS

To understand the present invention, it will now be described by way of example, with reference to the accompanying drawings and attachments in which:

FIG. 19 is a top plan view of a drip tray.

FIG. 20 is a detailed view of a connection between a piston arm and a cam roller assembly.

FIG. 21 is a detailed view of a connection between a piston arm and a cam roller assembly on an end of the drip tray opposite of the end shown in FIG. 20.

FIG. 22 is a perspective view of a portion of a flange supporting a cam roller assembly on one end of the drip tray.

FIG. 23 is an enlarged view, in perspective, of an end of a drip tray.

DETAILED DESCRIPTION

Figure 1:
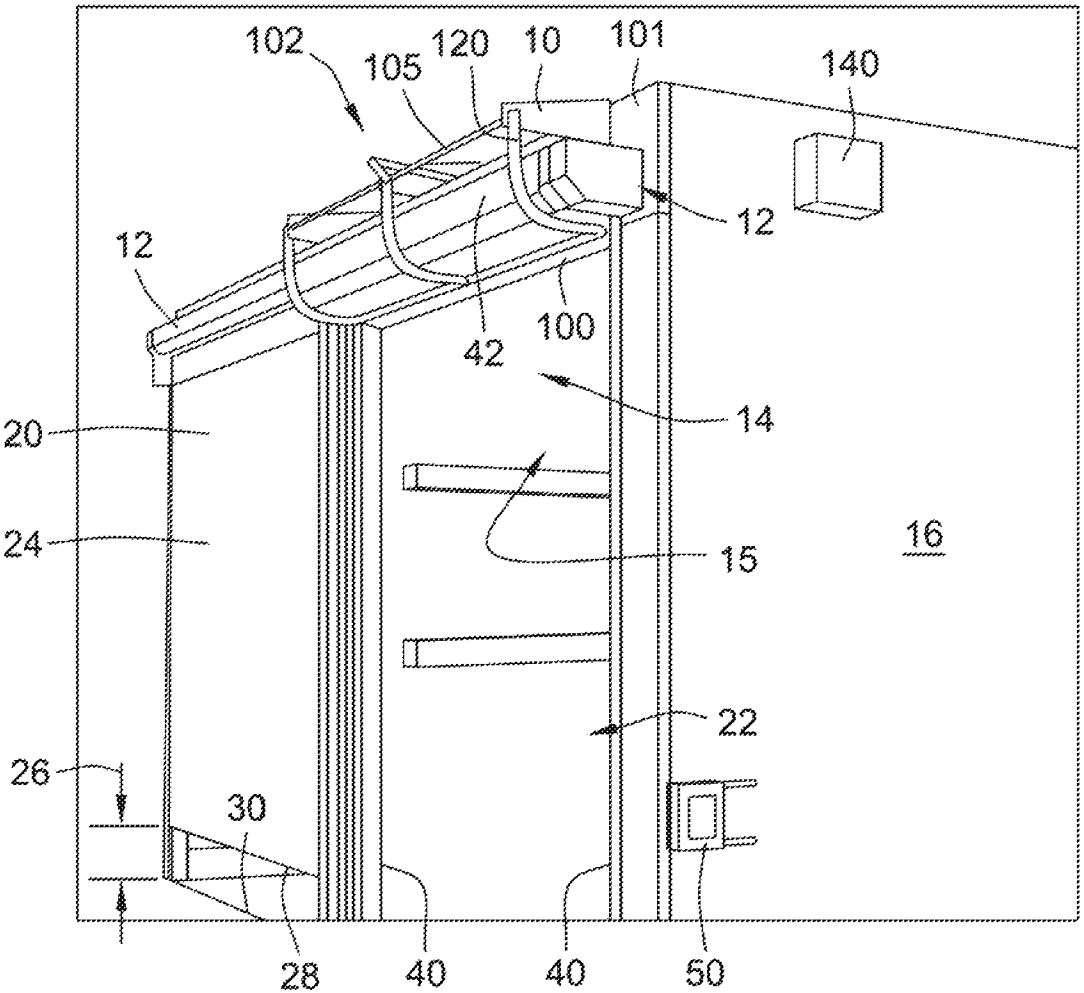
FIG. 1 is a perspective view of a liquid drainage assembly for a roll up door with a drip tray in an engaged position.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
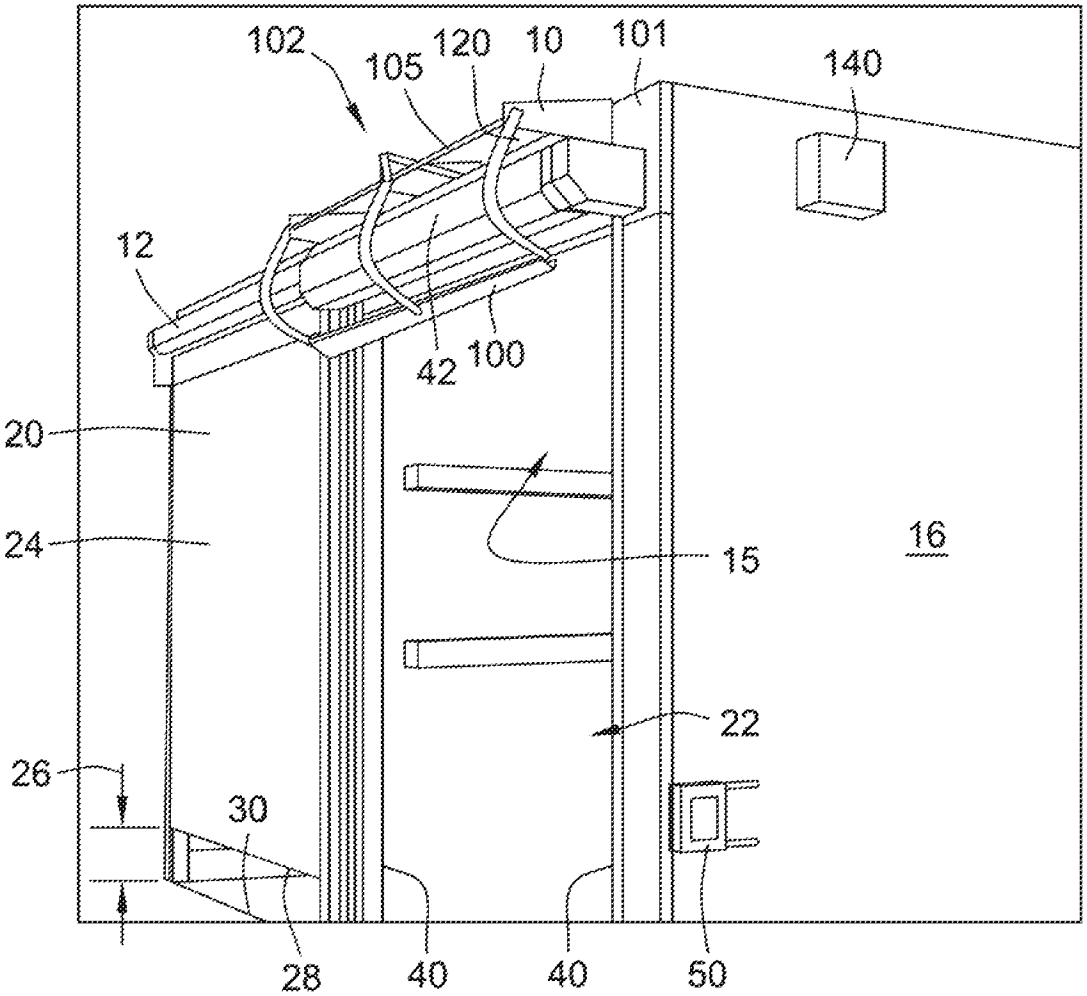
FIG. 2 is a perspective view of the liquid drainage assembly for a roll up door with the drip tray in a disengaged position.

FIGS. 1 and 2 show a liquid drainage assembly 10 for an automatic roll up door assembly 12. The liquid drainage assembly has a drip tray that moves from an engaged position shown in FIG. 1 to a disengaged position shown in FIG. 2. When in the engaged position, the drip tray catches flowable material such as liquid and solids moving downwardly across a bottom edge 28 of the door 20. This helps prevent water and other material from falling to the ground and pooling around the door and the opening creating a potentially hazardous situation. It also prevents dripping of the liquid on people and products passing through the opening 14. In the case of food products, the risk of contamination from run-off water is ameliorated by capturing the water so that it does not contact the food. When in the disengaged position, the drip tray is outside the vertical plane in which the door moves, and, therefore, does not interfere with the movement of the door. Thus, the liquid drainage assembly works in coordination with the door opening assembly 12.

The door opening assembly 12 provides and denies access to an opening 14 into a chamber 15 defined by walls 16. The roll up door assembly 12 has a door 20 that is moveable from an open position 22, through intermediate positions where there is a gap 26 between a bottom edge 28 of the door and the floor 30 (or other surface); to a closed position where the bottom edge of the door 28 is in contact with the surface. The door 20 is typically made from a web of material that spans the door opening and is capable of being stored on a roll when the door is in an open position. A plane extending between the guides defines a vertical plane through which the door moves.

Preferably, the door is an automatic-opening-type, and is capable of being moved by a motive power source from a stored/coiled position when the door is open to a deployed/uncoiled position when the door is closed. The door can be of a continuous material that defines both the full length and full width of the door. Suitable materials include cloth and polymeric sheet material, for example. The door can also include a plurality of individual slats connected together by hinges between each adjacent slat. The hinges allow the slats to pivot with respect to each adjacent slat so the door can be stored in a coil. One such suitable door is a rolling shuttered door.

The motive power source, for example, is an electric DC motor and drives a spool in a clockwise or counterclockwise direction to move the door between open and closed positions. The spool can be journaled at opposed ends for rotational motion and one end of the spool can be connected to the motive power source through a suitable connection such as a worm gear or other mechanism.

The door is connect d to the spool through a connecting member that preferably is capable of being stored in a coiled position and deployed in an uncoiled position together with the door. Suitable connecting members can include a length of material such as a strap, rope, wire, cable or other material or mechanism. The material can be connected using screws, brackets and the like to each individual slat or to groups of slats coupled together. The connecting member preferably spans the entire height of the door, from a top slat to a bottom slat of the door. In one form of the invention, a single connecting member is connected to the spool in a generally central position between the opposed ends of the spool. More preferably, there will be at least two connecting members, and preferably three or four connecting members. In one form of the invention, there are two, connecting members provided with one of each mounted proximate a lateral edge. In another embodiment, an additional connecting member is connected to a central portion of the spool.

The door 20 is moved in response to signals received from a controller 50 that is in electrical communication with the motive power source such as an electric motor (not shown). The electric motor will provide any motive and/or breaking forces necessary to operate the door. In a preferred form of the invention, the door assembly 12 further includes a sensor or an array of sensors to control the movement of the door for safe and efficient operation. Sensors can include remote control sensor, motion sensors, pressure sensors, proximity sensors, heat sensors, audio sensors, light sensors and the like known to those of ordinary skill in the art.

The controller 50 allows for both manual and automatic operation. Manual operation can be through a control that operates wirelessly or one that is hard wired. The controller 50 uses inputs from its sensor or sensors to ensure that the door is opened quickly enough to accommodate an approaching person, fork lift, or other vehicle, for example, for entry into or exit from the chamber 15. The controller also ensures the door is closed upon exit or after entrance of the fork lift or person when it is safe to do so. The controller has a processor, a memory and software instructions stored in the memory to provide a graphical user interface to allow a user to control parameters of the door opening and closing. The operating parameters can be varied and can include for example the hours of operation of the door, the location of the door in terms of how high above the ground is the bottom edge 28, the location of the door in terms of percent open, the speed of opening, the speed of closing, the time period where the door is left open, information relating to the type of sensors in use, and the data received from the sensors, alarm settings and others.

Figure 3:
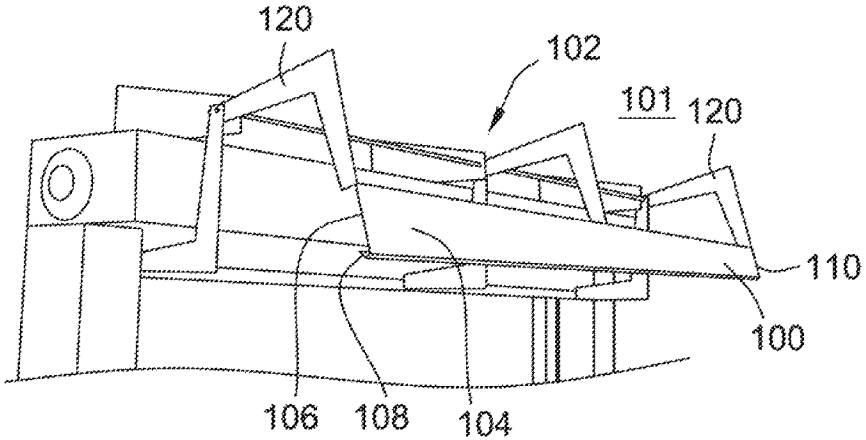
FIG. 3 is a perspective view of the drip tray in the disengaged position.
Figure 4:
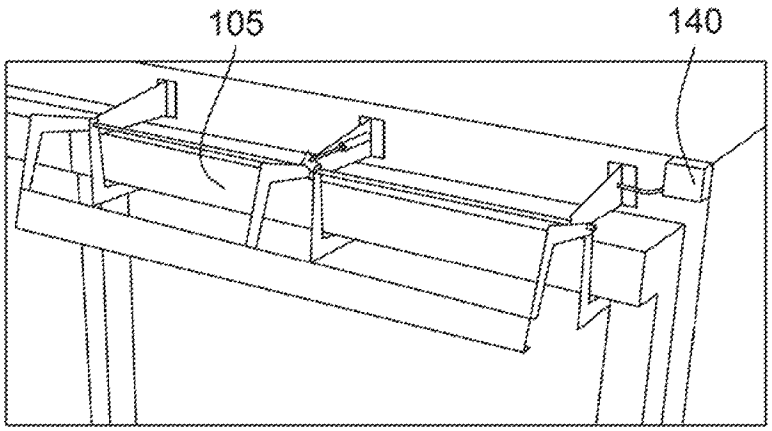
FIG. 4 is a top plan view of the drip tray in the disengaged position.
Figure 5:
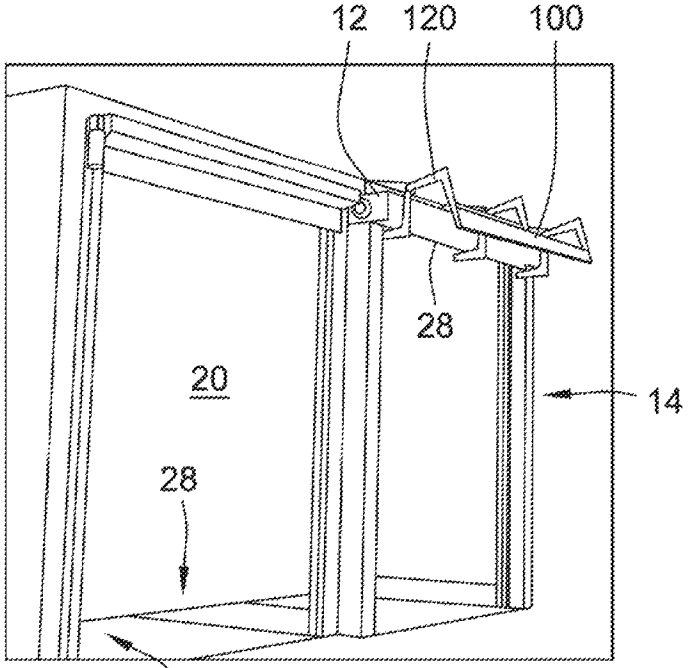
FIG. 5 is a perspective view of two roll up doors with one door having the liquid drainage assembly and the other door not having the liquid drainage assembly.
Figure 9:
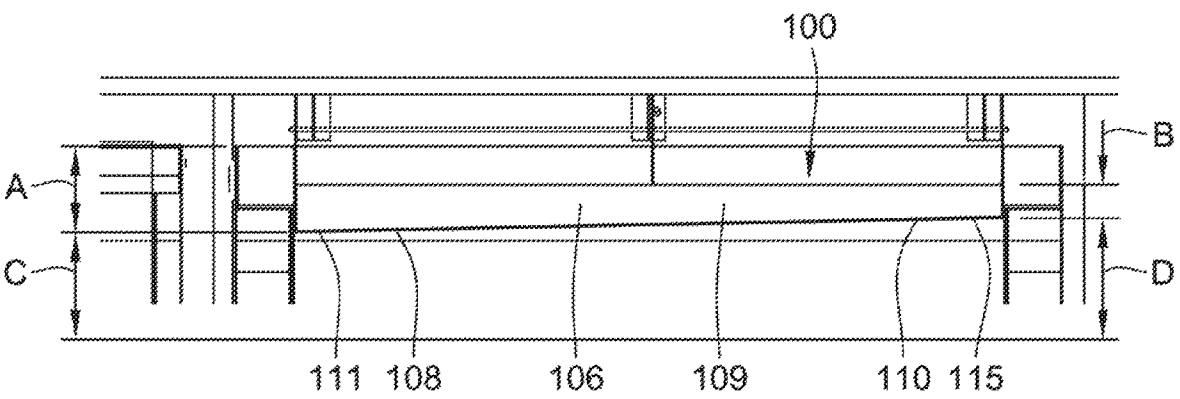
FIG. 9 is a front elevation view of the liquid drainage assembly with the drip tray in a disengaged position.

The liquid drainage assembly 10 has a deployable drip tray 100 mounted to a surface 101 through an attaching member 102 proximate a top of the opening 14. FIG. 1 shows the drip tray in an engaged position and FIGS. 3-5 show the drip tray 100 in a disengaged position. The drip tray has a width A (FIG. 9) at one end 110 and a width B at a second end 110. Width A is greater than width B so when the drip tray 100 is in the disengaged position as shown in FIG. 9, a lower portion 111 of the channel 106 at the first end 108 is a distance C above the floor 113, while a lower portion 115 of the channel 106 at the second end 110 is a distance D above the floor (FIG. 9). Distance D is greater than distance C and a sloping or tapering surface 109 connects portions 111 and 115. Accordingly, when the drip tray is in the disengaged position, liquids in the channel 106 will drain toward the first end 108.

Figure 7:
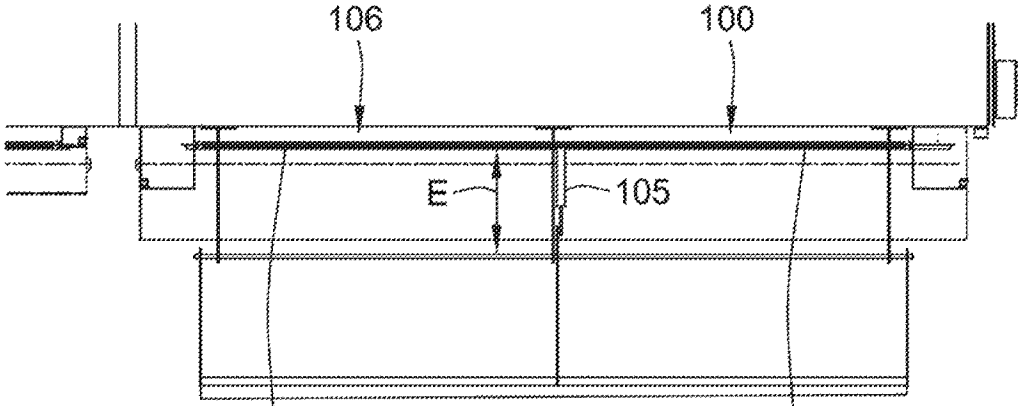
FIG. 7 is a front elevation view of the liquid drainage assembly with a drip tray in the engaged position.
Figure 6:
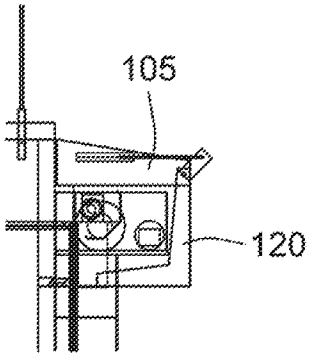
FIG. 6 is an end elevation view of the liquid drainage assembly with a drip tray in an engaged position.

However, when the drip tray 100 is in the engaged position as shown in FIGS. 1, 6 and 7, the drip tray is a distance E above, the floor, so liquids should not readily flow toward either end 108, 110 when the drip tray is in the engaged position.

Figure 8:
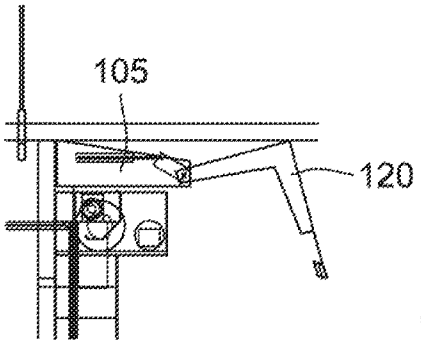
FIG. 8 is an end elevation view of the liquid drainage assembly with the drip tray in a disengaged position.
Figure 10:
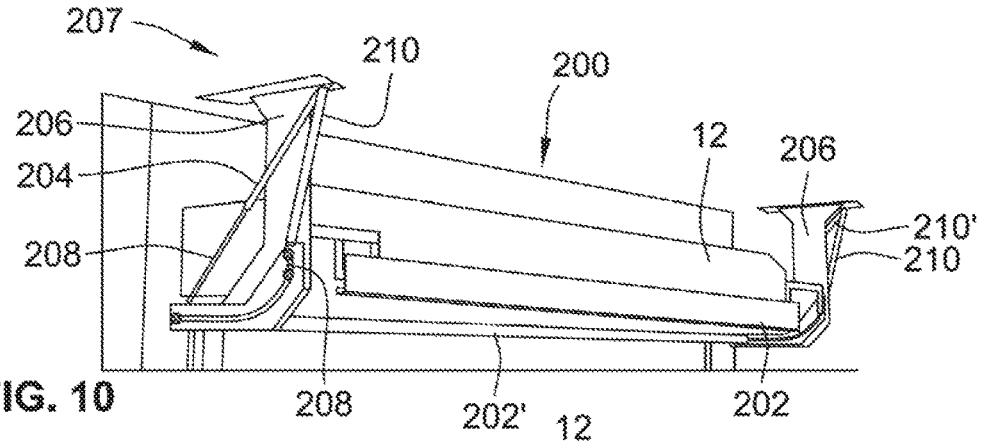
FIG. 10 is a perspective view of another aspect of a liquid drainage assembly for a roll up door with a drip tray shown both in an engaged position and a disengaged position.
Figure 11:
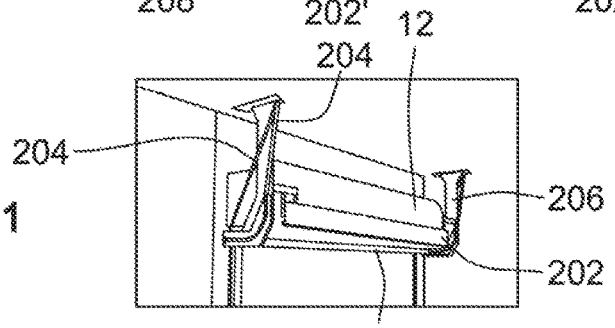
FIG. 11 is a perspective view of an entryway to a pair of automatic doors with the liquid drainage assembly for a roll up door is associated with one of the automatic doors.
Figure 12:
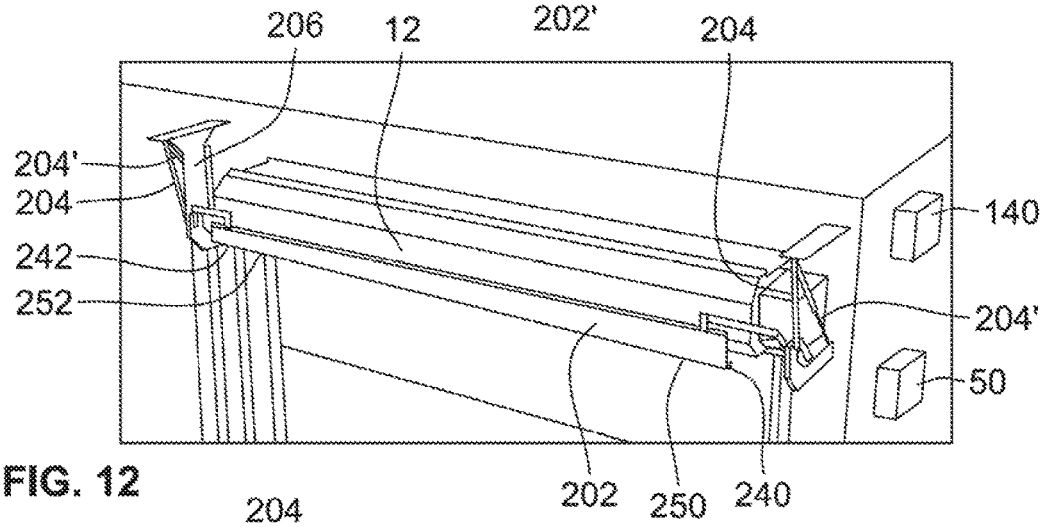
FIG. 12 is a perspective view of a liquid drainage assembly for a roll up door with a drip tray in a disengaged position and the automatic door in operation.
Figure 13:
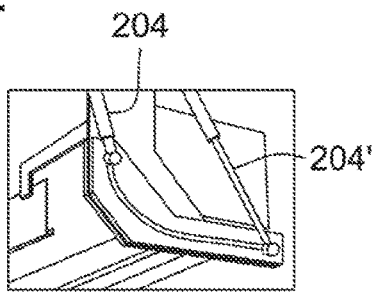
FIG. 13 is a perspective view of an outside portion of a cylinder and piston assembly of the liquid drainage assembly of FIG. 10.
Figure 14:
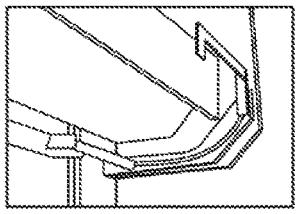
FIG. 14 is a perspective view of an inside portion of a cylinder and piston assembly of the liquid drainage assembly of FIG. 10.

The attaching member 102 has three L-shaped arms 120 spaced from one another and each is connected at one end to a shaft 105 (FIG. 4) and a second end to the drip tray 100. The arms 120 are moved in unison upon rotation of the shaft 105 in response to translational movement of a piston 130. The arms move through an arcuate path as shown in FIGS. 6 and 8. The piston is pneumatically or hydraulically driven in response to a signal received from a drainage assembly controller 140. The drainage assembly controller 140 is electrically coupled to the door assembly controller 50 and operates in coordination therewith. Thus, when the door is in the fully open position, the drip tray is in the engaged position. When the door is in any other position, the drip tray is in the disengaged position outside the vertical plane in which the door moves.

FIGS. 10-26 show another aspect of a drainage assembly 200 having a drip tray 202 mounted for movement between a disengaged position 202 and an engaged position 202' by a cylinder and piston assembly 204,204'. While two drip trays 202,202' and two cylinder-and-piston assemblies 204, 204' are shown, it should be understood that this is a superposition of these components at two different points in time and is for demonstration purposes only. Only a single one of each item is present at a point in time. The piston and cylinder assembly 204, as the name describes, has a piston arm 208 that moves in and out of a lumen of a cylindrical wall 210. When the piston arm 208' is at or near the point of being fully extended, the drip tray 202' is in the engaged position. When the piston assembly is at or near its fully inserted position 208, the drip tray 202 is in the disengaged position. The piston can be pneumatically or hydraulically driven and more preferably pneumatically driven. As set forth above, the drainage assembly 200 has a drainage assembly controller 140 coupled to a door assembly controller 50 and functions as described above.

Figure 16:
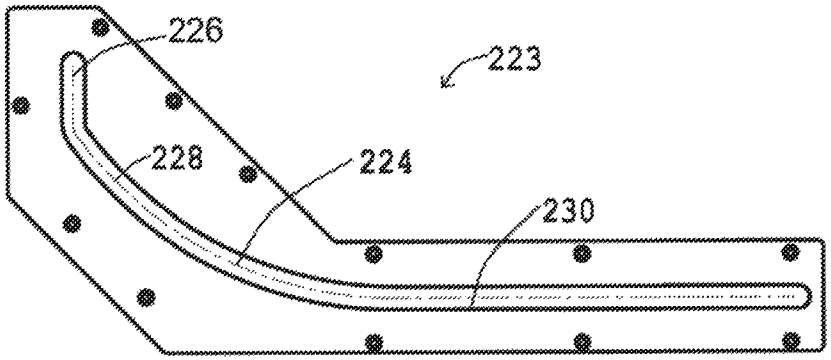
FIG. 16 is a side elevation view of a cam guide, or segmented slot.
Figure 17:
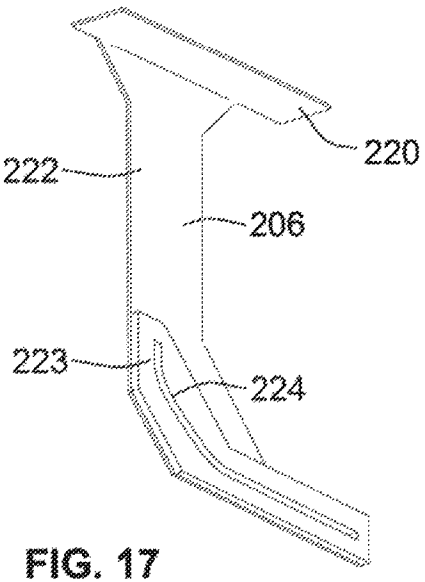
FIG. 17 is a perspective view of a mounting bracket with a cam guide or segmented slot.
Figure 18:
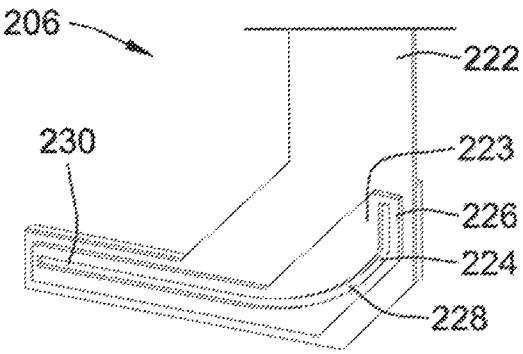
FIG. 18 is an enlarged view of a portion of a mounting bracket and cam guide, or segmented slot.

The drainage assembly 200 is mounted to a surface above and proximate the door opening by a pair of horizontally spaced brackets 206. As best seen in FIGS. 16-18, the bracket 206 is generally J-shaped having an upper rectangular plate 220, for attaching to the surface such as a ceiling 207 using suitable fasteners, and a downwardly depending flange 222 extending along a lateral edge of the door opening and supporting a cam guide 223 at a lower end of the flange 222. The cam guide 223, which sometimes will be referred to as a segmented slot, has an arcuate shaped slot 224 in registration with a correspondingly shaped slot extending through the entire thickness of the flange 222. The arcuate slot 224 guides the movement of the drip tray 202 through three segments. When the drip tray is in the disengaged position 202, a connecting portion 299 (FIG. 22) of the drip tray 202 is positioned in a vertical segment 226. A generally crescent shaped second segment 228 connects the vertical segment 226 to a flat, horizontal segment 230. The shape of the slot 224 ensures proper positioning of the drip tray in the engaged and disengaged positions and for movement between the positions without contacting the door opening mechanism 12. The movement includes horizontal, vertical and rotational movement of the drip tray.

Figure 25:
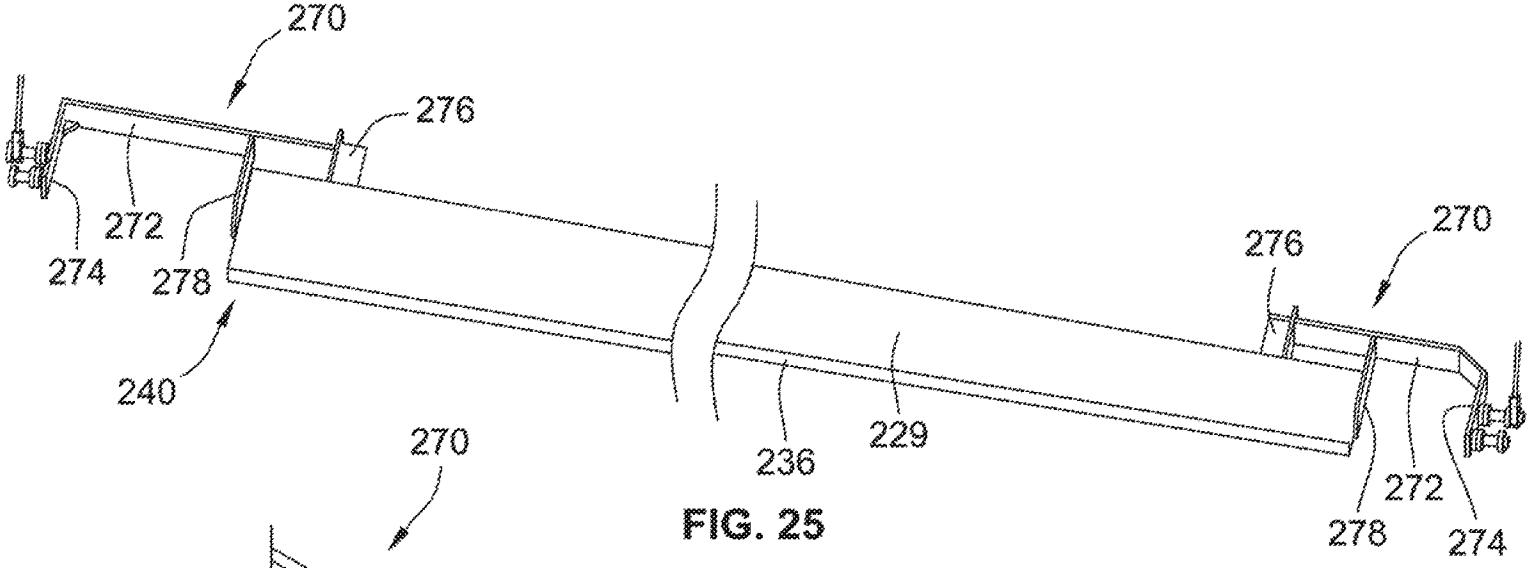
FIG. 25 is a perspective view of a drip tray.

FIGS. 19 and 25 show the drip tray 202 has a generally C-shaped cross sectional shape having an upstanding front wall 236 and rear wall 238, connected together by a bottom wall 239 defining a liquid channel. At a first end 240, the front wall 236 is spaced from the rear wall 238 by a distance A (width), and at a second end 242 a distance B. Width A is greater than width B. When the drip tray 202' is in the engaged position, the liquid channel 239 is positioned below the bottom edge of the door to catch any liquid run off from the door. The liquid channel is flat from one end to the opposed end so liquid does not readily flow between the ends. However, when the drip tray 202 is in the disengaged position shown in FIG. 12, the greater width A results in a low end 250 of the drip tray being closer to the ground than a high end 252 of the drip tray. A sloping surface 253 (FIG. 19) connects the opposed ends 250, 252 to accommodate a flow of liquid from the high end 252 to the low end 250.

Brackets 270 are connected at the opposed ends 240, 242 of the drip tray 202 to an outer surface of the rear wall 238. Each bracket 270 has an elongate beam 272, a first flange 274 at a distal end of the beam, a second flange 276 at a proximal end of the beam and a third flange 278 intermediate of the first and second flanges, each of these flanges extending generally perpendicularly front the beam 272 in the same direction. A gusset 280 extends between the first flange 274 and a distal end of the beam 272 to provide support.

The first flange 274 supports an assembly 282 for engaging the arcuate slot 224 of the cam guide 223. In one preferred form of the invention, the assembly 282 has a first roller assembly 284 and a second roller assembly 286 extending axially away from the rear wall 238. The first roller assembly 282 has an axle 290 extending through a through hole in the first flange and attached to the flange. The axle supports, from a proximal portion to a distal portion, a pair of spacers 292, a pair of rollers 294, a terminal spacer 296, and a stop member 298.

Figure 26:
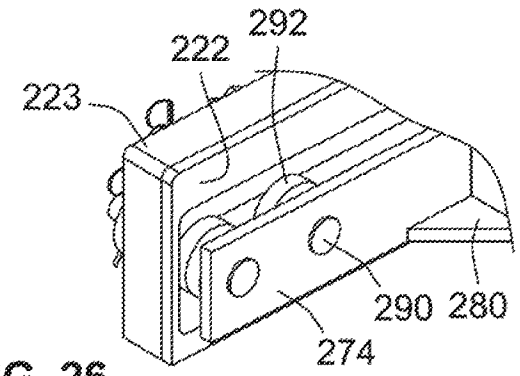
FIG. 26 is an enlarged view of a cam assembly engage a cam guide, or segmented slot.
Figure 24:
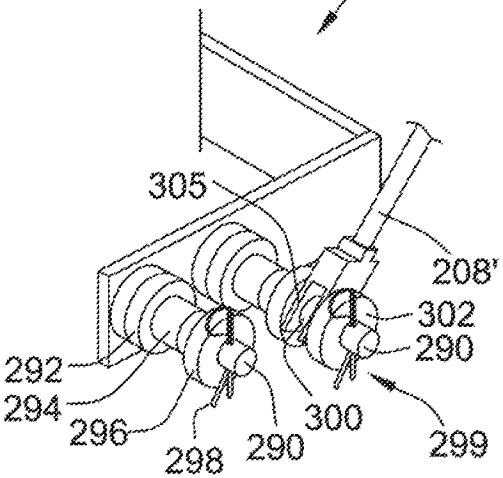
FIG. 24 is a perspective view of a portion of a flange supporting a cam roller assembly on an end of the tray opposite from that shown in FIG. 22.

The second roller assembly is the same as the first but also has a terminal connection member 299 for connecting the drip tray 202 to the piston rod 208. In one preferred form of the invention, the terminal connection member 299 includes a second roller 300 and a second terminal spacer 302 distal of the first terminal spacer 296 (FIGS. 22 and 24). As shown in FIG. 26, for each of the roller assemblies 282, 284, the axle 290 extends through the arcuate slot 224 with the first set of spacers 292 engaging an inner surface of the cam guide 223 along the slot 224. Next, the first set of rollers 294 engages an edge of the slot 224, and the terminal spacer 296 contacts an outer surface of the cam guide 223. Preferably the rollers have a diameter so that they contact both an upper and a lower edge of the slot 224 to minimise axial directed movement of the rollers. The spacers maintain the rollers in a desired lateral location in the slot to reduce friction, minimize vibration, chattering (transverse movement along the axis causing the spacers to impact a facing surface of the cam guide) and wear and tear of these parts.

The terminal connection member 299 connects to the piston rod through a clevis 304 attached to a terminal end of the piston rod through a suitable connector such as a threaded connection. The clevis 304 has a pair of spaced tines 305, each tine having a through hole in alignment with the other to receive the axle 290 and to rotate thereabout. The tines 305 of the clevis are sandwiched between the first and second terminal spacers 296, 302 and span the second roller 300. While the figures show a pair or rollers or a pair of spacers, these components could be replaced by a single roller or a plurality of so long as they provide the desired functionality.

The axles 290 have an axially extending through hole at a distal end to receive the cotter pin 298. Other stop mechanisms could be used in place of the cotter pin including a cap that covers the end of the axle, or a C-shaped clip that is dimensioned to form an interference fit about a portion of the circumference of the axle.

Moving on to the intermediate flange 278, FIG. 23 shows one end of the drip tray 202 and the intermediate flange 278 extends across a portion of the channel 229 of the drip tray and abuts a terminal edge of the bottom wall 239, and a terminal edge of the rear wall 238 and is connected thereto with a weld or other seam. The intermediate flange has an inner surface 322 to guide liquid to an exit 320 of the drip tray. It also strengthens the connection of the beam 272 to the drip tray.

Now, the third flange 277 connects an outer surface of the rear wall to the beam 272. Preferably the parts are connected by a weld.

The parts described may be manufactured from any suitable material and by any suitable manufacturing process. Suitable materials include, for example, metals, plastics, and composites.

Figure 15:
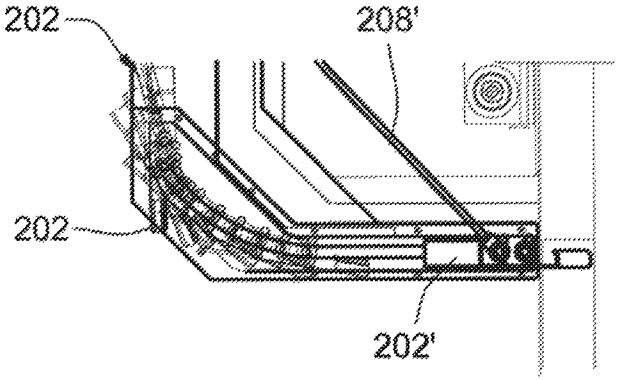
FIG. 15 is a side elevation view of a drip tray in multiple positions between an engaged position and a disengaged position.

In operation, when the automatic door is fully open, the drip tray moves from the disengaged position to the engaged position following the arcuate slot 224 of the cam guide 223. When in the disengaged position, the first and second roller assemblies 284, 286 are positioned in the vertical segment 226 of the arcuate slot. The open channel 229 is facing the door and liquid can drain from the high end to the low end and outward through the exit 320. When the roller assemblies are in the second segment 228 the drip tray is moving away from the door surface through an arcuate path with the open channel moving from being generally vertically disposed to being nearly horizontally disposed (FIG. 15). When the roller assemblies are in the third segment, the open channel is facing upward and the drip tray moves inwardly until the open channel is under the bottom edge of the door. The channel is generally flat from end to end so liquid will not readily flow between the opposed ends by the force of gravity. When it is safe to do so, the drip tray reverses this order of movement from the engaged position to the disengaged position. Once the drip tray is outside the vertical plane of the door, the door can begin to close.

The term liquid is meant to include liquids such as water, aqueous solutions, and liquids containing solids such as liquid water containing solid water (ice). Other solid flowable materials can also be in the liquid such as dust, sand, and other granular material, for example. The liquid can be other than water both is most commonly water.

Many modifications and variations of the present invention are possible in light of the above teachings. It is, therefore, to be understood within the scope of the appended claims the invention may be protected otherwise than as specifically described.

We claim:

1. A liquid drainage assembly for a roll-up door, the roll-up door having a web of material, a spool and a mounting bracket for rotatably mounting the spool to a surface above an opening for movement of the web of material along a vertical path from a first position where the web of material covers the opening to a second position where the web of material permits access to the opening comprising:

an attaching member connecting a drip tray to the surface above the spool proximate the opening, the attaching member moveable from a third position to a fourth position through an arcuate path that brings the drip tray outward from the surface and over the spool, the drip tray having a wall defining a channel and when the drip tray is in the fourth position the channel is disposed under a bottom edge of the door;

a piston for moving the drip tray between the third position and the fourth position; and a controller connected to the piston and configured to generate a signal in response to the door moving to the second position to move the drip tray to the fourth position.

2. The liquid drainage assembly of claim 1 wherein the controller generates the signal in response to the door moving from the second position toward the first position to move the drip tray from the fourth position toward the third position.

3. The liquid drainage assembly of claim 2 wherein when the drip tray is in the third position it is outside the vertical path prior to the door moving from the second position toward the first position.

4. The liquid drainage assembly of claim 2 wherein the controller prohibits the door from moving from the second position when the drip tray is in the fourth position.

5. The liquid drainage assembly of claim 1 wherein the drip tray is elongate having a first end and a second end opposed to the first end and the channel slopes downwardly from the first end to the second end.

6. The liquid drainage assembly of claim 1 wherein the drip tray moves along an arcuate path from the third position to the fourth position.

7. The liquid drainage assembly of claim 1 wherein the piston is a pneumatic piston or a hydraulic piston.

8. A liquid drainage assembly for a roll-up door, the roll-up door having a web of material, a spool and a mounting bracket for rotatably mounting the spool to a surface above an opening for movement of the web of material along a vertical path from a closed position where the web of material covers the opening to an open position where the web of material permits access to the opening comprising:

a drip tray has a first end, a second end opposed to the first end, a front wall, a rear wall and a bottom wall connecting the front wall to the rear wall, at the first end of the drip tray the front wall is spaced from the rear wall by a first distance and at the second end of the drip tray the front wall is spaced from the back wall by a second distance less than the first distance;

a first bracket attached to a surface above the spool and is positioned proximate either the first end or the second end of the drip tray to define a connected end of the drip tray, the bracket supports a first segmented slot;

a first member connecting the connected end of the drip tray to the first segmented slot;

a motive power force is connected to the first member to move the first member in the first segmented slot from a first position to a second position, when in the first position the drip tray is in the vertical path, and when the first member is in the second position it is outside the vertical path; and, a controller connected to the motive power source to move the first member to the first position when the door is in an open position and to move the first member to the second position prior to the door moving from the open position.

9. The assembly of claim 8 further comprising a second bracket supporting a second segmented slot opposite the first segmented slot and a second member connecting the drip tray to the second segmented slot on an end of the drip tray opposite the connected end.

10. The assembly of claim 9 wherein the first segmented slot has a vertical segment and a horizontal segment.

11. The assembly of claim 10 wherein the first segmented slot has an arcuate-shaped segment connecting the vertical slot with the horizontal slot.

12. The assembly of claim 11 wherein when the first member is in the horizontal segment the bottom wall is horizontal and when the first member is in the vertical segment the bottom wall is vertical.

13. The assembly of claim 12 wherein when the bottom wall is vertical one end of the front wall is positioned above an opposed end of the front wall to allow liquid to flow toward the opposed end.

14. The assembly of claim 13 wherein the motive power source is an electric motor.

15. The assembly of claim 14 wherein a piston and cylinder assembly connects the first member to the motor.

16. The assembly of claim 15 wherein the piston and cylinder assembly is actuated pneumatically or hydraulically.

17. The assembly of claim 15 wherein the piston and cylinder assembly is actuated pneumatically.

18. The assembly of claim 13 further comprising a flange connected to the opposed end to direct fluid to an exit of the drip tray.

19. The assembly of claim 15 further comprising a roller assembly connected to the piston rod and positioned in the first segmented slot.

* * * * *